US008101045B2

(12) United States Patent
Furman et al.

(10) Patent No.: US 8,101,045 B2
(45) Date of Patent: Jan. 24, 2012

(54) MODIFYING AGENT FOR YANKEE COATINGS

(75) Inventors: Gary S. Furman, St. Charles, IL (US); Xiaojin Harry Li, Palatine, IL (US); Winston Su, Naperville, IL (US); Vladimir A. Grigoriev, Atlanta, GA (US)

(73) Assignee: Nalco Company, Naperville, IL (US)

( * ) Notice: Subject to any disclaimer, the term of this patent is extended or adjusted under 35 U.S.C. 154(b) by 187 days.

(21) Appl. No.: 12/652,059

(22) Filed: Jan. 5, 2010

(65) Prior Publication Data

US 2011/0162811 A1 Jul. 7, 2011

(51) Int. Cl.
*B31F 1/12* (2006.01)

(52) U.S. Cl. ..... 162/112; 162/164.1; 156/183; 264/283

(58) Field of Classification Search ..... 162/111–113, 162/158, 164.1, 164.3, 168.1, 168.3; 156/183; 264/282–284; 428/195.1
See application file for complete search history.

(56) References Cited

U.S. PATENT DOCUMENTS

| | | | | |
|---|---|---|---|---|
| 5,179,150 | A | 1/1993 | Furman, Jr. et al. | |
| 5,187,219 | A | 2/1993 | Furman, Jr. | |
| 5,374,334 | A | 12/1994 | Sommese et al. | |
| 5,382,323 | A | 1/1995 | Furman, Jr. et al. | |
| 5,660,687 | A | 8/1997 | Allen et al. | |
| 5,833,806 | A * | 11/1998 | Allen et al. | 162/111 |
| 6,277,242 | B1 | 8/2001 | Archer et al. | |
| 2005/0241786 | A1 * | 11/2005 | Edwards et al. | 162/109 |
| 2007/0054986 | A1 * | 3/2007 | Nguyen | 524/35 |
| 2007/0151684 | A1 * | 7/2007 | Grigoriev et al. | 162/111 |
| 2008/0105394 | A1 * | 5/2008 | Kokko | 162/111 |
| 2009/0130006 | A1 | 5/2009 | Wang et al. | |
| 2009/0133846 | A1 * | 5/2009 | Grigoriev et al. | 162/112 |
| 2011/0092743 | A1 * | 4/2011 | Li et al. | 568/679 |
| 2011/0162811 | A1 * | 7/2011 | Furman et al. | 162/111 |

FOREIGN PATENT DOCUMENTS

| | | | |
|---|---|---|---|
| EP | 505002 | A2 * | 9/1992 |
| WO | WO 2007092407 | A2 * | 8/2007 |

* cited by examiner

*Primary Examiner* — Jose A Fortuna

(74) *Attorney, Agent, or Firm* — Benjamin E. Carlsen; Michael B. Martin

(57) ABSTRACT

The invention provides a composition of matter useful for producing very soft high grades of tissue paper. The composition of matter comprises an adhesive composition that includes a glycerol-based polyol. The glycerol-based polyol prevents the composition from becoming brittle and is non-volatile. This allows the composition to become rewetted after creping and allows for strong levels of adhesion even at high temperatures.

14 Claims, 5 Drawing Sheets

Polyglycerol Structure

Repeating Units in Polyglycerol

TGA Volatility of Glycerol vs. Polyglycerols

Weight Loss for Aqueous Solutions of Glycerol and Polyglycerol

MODIFYING AGENT FOR YANKEE COATINGS

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to compositions of matter and methods of using them to improve the physical properties of manufactured paper, in particular making soft tissue paper. Typically, tissue paper obtains its characteristic properties of softness, bulk, absorbency, and ability to stretch, by a process involving a Yankee Dryer apparatus. In conventional tissue-making the tissue is fed to the Yankee Dryer apparatus as a wet fiber web. The wet fiber web is significantly dewatered at a pressure roll nip where the sheet is transferred to the surface of a Yankee Dryer cylinder. At this point, the paper web typically has 35-40% consistency (it is 65-60% water). The sheet is further dried by the steam-heated Yankee Dryer cylinder and hot air impingement hoods to 90-98% consistency and removed with a doctor blade. The mechanical action of the blade results in a disruption of the fiber-fiber bonds, which forms a microfold structure that gives the tissue paper its characteristic properties. This process is referred to as creping.

In order to properly crepe a paper web to make soft tissue paper, the paper web has to adhere to the surface of the Yankee dryer cylinder. When the paper web then collides with the doctor blade, microfolds are formed in the machine direction by the compressing, or shortening action, while at the same time the web is separated from the drying cylinder. This adhesion is facilitated by the application of an adhesive to the surface of the dryer cylinder. In addition, wet-end furnish components can also contribute to the adhesion that occurs. Commonly used Yankee adhesives are synthetic polymers such as polyaminoamide-epichlorohydrin (PAE) resins, polyamine-epichlorohydrin resins, polyvinyl alcohols, polyvinyl acetates, polyacrylamides, polyamines, polyvinylamines, polyamides, polyvinylpyrrolidones, polyethers, polyethyleneimines, crosslinked vinyl alcohol copolymers, and others described in U.S. Pat. No. 5,374,334. Other natural and derivitized natural polymers may also be employed including starch, guar gum, carboxymethyl cellulose, hydroxyethyl cellulose, hydroxypropyl cellulose and the like. Various lower molecular weight compounds, release agents, oils and surfactants, are used to modify the properties of these adhesives.

The tissue industry has a continuing interest in manufacturing premium grade tissues, which are tissues with high levels of softness and bulk. Improvements in softness can be obtained by modifying the fiber source, implementing particular forming and drying strategies, creping the fiber sheets, and by using wet-end or topical application of softening agents. Creping the paper sheet when it has a very low sheet moisture level (<3%) is a very effective way of achieving desired levels of high softness and bulk. At low moisture levels, the sheet and the coating tend to adhere to each other more strongly which causes the sheet to debond in the Z-direction more efficiently thereby generating greater bulk and softness. Low moisture levels can be achieved by increasing the temperature of the Yankee dryer and hoods.

Despite the benefits for tissue softness, low moisture creping is not being widely practiced due in part to coating runnability issues. Conventional creping adhesives typically develop a hard coating which is less rewettable after undergoing the high temperatures and extensive drying that is required for low moisture creping. This hard and brittle coating results in a loss of adhesion and also results in blade vibration (chatter), which can cause non-uniform creping, blade wear, and, in extreme cases, damage to the Yankee dryer cylinder surface.

One attempted method of addressing these problems is by using humectants to plasticize the adhesive and thereby counteract many of the consequences of high Yankee Dryer temperatures. One such humectant is glycerol (see for example U.S. Pat. Nos. 5,187,219 and 5,660,687). Glycerol has been shown to alter the viscoelastic properties of a coating film. In addition, it decreases the glass transition temperature and shear modulus of the film, making it softer and more rewettable in both high and low temperature conditions. Unfortunately when in dilute aqueous form, as is the case when applied to Yankee dryers, the volatility of glycerol/water mixtures limits glycerol's effectiveness as a plasticizer. Because water is also common in Yankee Dryer environments there is a great demand for a modifying agent that placticizes the film but is not as volatile as glycerol.

BRIEF SUMMARY OF THE INVENTION

At least one embodiment of the invention is directed towards a method of creping a paper web comprising the steps of:

a) applying to a rotating creping cylinder a coating composition, the coating composition comprising at least one adhesive agent, at least one release agent, and at least one polyglycerol;

b) pressing the paper web against the creping cylinder to effect adhesion of the paper web to the creping cylinder; and c) dislodging the paper web from the creping cylinder with a doctor blade.

The coating composition can remain plasticized at a temperature beyond the volatility limit of glycerol. The polyglycerol can be between 1 and 70% of the coating composition. The coating composition can have a glass transition temperature of less than 100° C. The coating composition can be readily rewettable after the paper has been dislodged from the creping cylinder.

The polyglycerols can be selected from the group consisting of polyglycerol according to the formula:

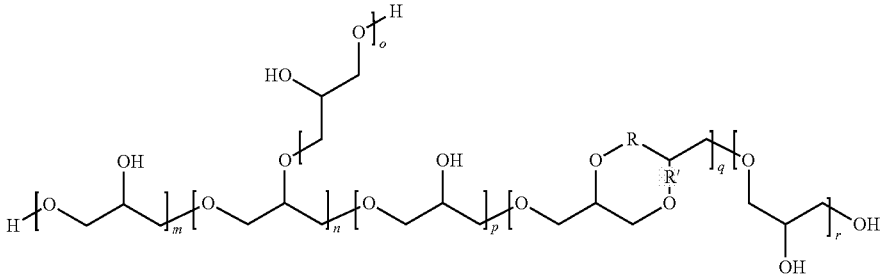

wherein m, n, o, p, q, and r are equal to an integer from 0 to 25 polyglycerol formed by crosslinking glycerol with epichlorohydrin, base condensation polyglycerols, polymerization of glycidol-based monomers, and any combination thereof.

The polyglycerol structure can be selected from the group consisting of linear, branched, hyperbranched, dendritic, cyclic and any combination thereof. The polyglycerol can have a molecular weight greater than 100 g/mole. The coating can further comprise polyaminoamide-epichlorohydrin (PAE) resins, polyamine-epichlorohydrin resins, polyacrylamides, polyvinylamines, polyvinylpyrrolidones, natural polymers, derivitized natural polymers, starch, guar gum, carboxymethyl cellulose, hydroxyethyl cellulose, hydroxypropyl cellulose, functional additives, organic quaternary salts having fatty chains of about 12 to about 22 carbon atoms, dialkyl imidazolinium quaternary salts, dialkyl diamidoamine quaternary salts, monoalkyl trimethylammonium quaternary salts, dialkyl dimethylammonium quaternary salts, trialkyl monomethylammonium quaternary salts, ethoxylated quaternary salts, dialkyl and trialkyl ester quaternary salts, polysiloxanes, quaternary silicones, organoreactive polysiloxanes, amino-functional polydimethylsiloxanes, polyamines, polyamides, polyamidoamines, amidoamine-epichlorohydrin polymers, polyethyleneimines, polyvinyl alcohol, vinyl alcohol copolymers, polyvinyl acetate, vinyl acetate copolymers, polyethers, polyacrylic acid, acrylic acid copolymers, cellulose derivatives, starches, starch derivatives, animal glue, crosslinked vinylamine/vinylalcohol polymers, glyoxalated acrylamide/diallyldimethyl acrylamide copolymers, halogen-free creping cylinder adhesives based on cross-linked cationic polyaminoamide polymers, and any combination thereof. The coating composition can further comprise lactic acid or lactate, can further comprise release agents, other modifiers (including phosphates), and functional additives, polyglycerols, polyglycerol derivatives, any other glycerol-based polyols, and any combination thereof.

The release aid can comprise one item selected from the group consisting of: release oils composed of naphthenic, paraffinic, vegetable, mineral or synthetic oil and emulsifying surfactants, release aids formulated with one or more surfactants such as fatty acids, alkoxylated alcohols, alkoxylated fatty acids, and any combination thereof. The coating composition can be applied as an aqueous solution, an emulsion, or a dispersion. Creped paper can be prepared according to the inventive method.

BRIEF DESCRIPTION OF THE DRAWINGS

A detailed description of the invention is hereafter described with specific reference being made to the drawings in which.

DETAILED DESCRIPTION OF THE INVENTION

Definitions

Figure 1:
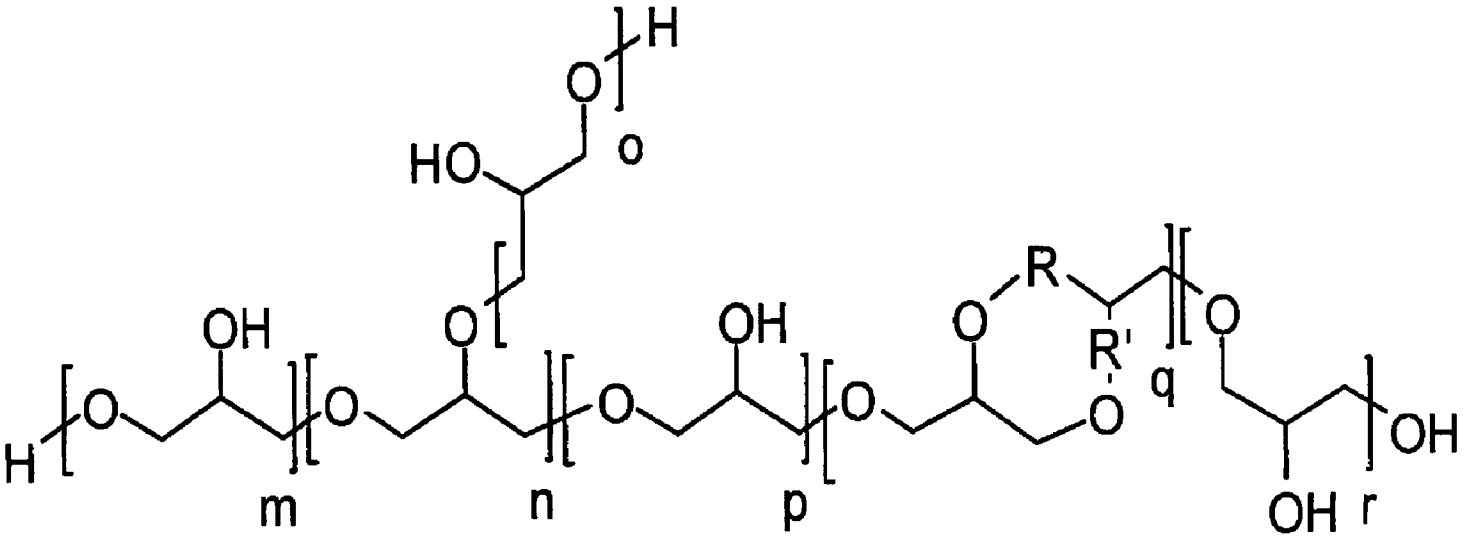
FIG. 1 is an illustration of the structure of suitable polyglycerols for use in the inventive film.

For purposes of this application the definition of these terms is as follows:

"Dispersion" means a thermodynamically unstable mixture of extremely fine solid particles, typically of colloidal size, which are highly dispersed throughout a continuous phase liquid that it is otherwise immiscible with. Dispersions can be at least temporarily stabilized by dispersing agents.

"Emulsion" means a thermodynamically unstable mixture of a dispersed phase liquid, which is highly dispersed as small globules throughout a continuous phase liquid that it is otherwise immiscible with. Emulsions can be at least temporarily stabilized by surfactants and emulsifiers.

"Polymeric Polyol" means a polymer in which the monomer repeating units comprising the polymer are at least in part polyols and includes but is not limited to polyglycerols, polyglycerols derivatives, and a polymer consisting of at least one glycerol monomer unit and at least another monomer unit to other multiple monomers units regardless of the sequence of monomers unit arrangements and any combination thereof.

"Polyol" means a compound or polymer containing at least two hydroxyl groups in which each of these at least two hydroxyl groups are attached to separate carbon atoms of an aliphatic skeleton, including but not limited to glycols, glycerol, pentaerythritol, trimethylolethane, trimethylolpropane, 1,2,6-hexanetriol, sorbitol, inositol, poly(vinyl alcohol) and glycerol-based polyols.

"Placticizer" means a substance which when added to a material causes an increase in the flexibility and workability of that material, often as a result of lowering the glass transition temperature of that material.

In the event that the above definitions or a definition stated elsewhere in this application is inconsistent with a meaning (explicit or implicit) which is commonly used, in a dictionary, or stated in a source incorporated by reference into this application, the application and the claim terms in particular are understood to be construed according to the definition in this application, and not according to the common definition, dictionary definition, or the definition that was incorporated by reference.

At least one embodiment of the invention is directed towards a Yankee Dryer coating composition comprising an adhesive, a release agent, and a modifying agent. The adhesive binds a paper mat to the drum surface of the Yankee Dryer. The invention encompasses applications to paper mats comprising cellulosic fibers, synthetics fibers, and any combination thereof. The release agent reduces the strength of the adhesive to allow a doctor blade to remove the dried paper mat from the drum. The modifying agent plasticizes the coating composition, keeping it soft, and allowing it to become rewetted and to maintain the adhesion while in the presence of high temperature. A description of Yankee Dryer coating compositions is given in U.S. patent application Ser. No. 12/273,217.

In at least one embodiment the modifying agent is a composition that comprises glycerol-based polymeric polyol, including polyglycerols, polyglycerol derivatives, and a polymer consisting of at least one glycerol monomer unit and at least another monomer unit to other multiple monomers units regardless of the sequence of monomers unit arrangements. Suitable glycerol-based polymeric polyol include but are not limited to those described in U.S. patent application Ser. No. 12/582,827 and US Published Patent Application 2009/0130006. In at least one embodiment the polymeric polyol has a molecular weight of more than 100.

In at least one embodiment the modifying agent is a composition that comprises polyglycerols. Suitable polyglycerols include but are not limited to those described in U.S. patent application Ser. No. 12/582,827 and US Published Patent Application 2009/0130006. In at least one embodiment the polyglycerol has a molecular weight of more than 100. Although it is known that glycerol does have some use as a plasticizer in other materials, for example as described in U.S. Pat. No. 5,187,219, it has not been previously attempted to use polyglercerol in Yankee dryer coatings.

In at least one embodiment, the polyglycerol is one selected from the list consisting of diglycerol, triglycerol, and higher analogs, as specified by the structure illustrated in FIG. 1. The polyglycerols may be prepared by crosslinking with epichlorohydrin, through the condensation of glycerol, by polymerization of glycidol-based monomers, or any combination thereof.

Figure 2:
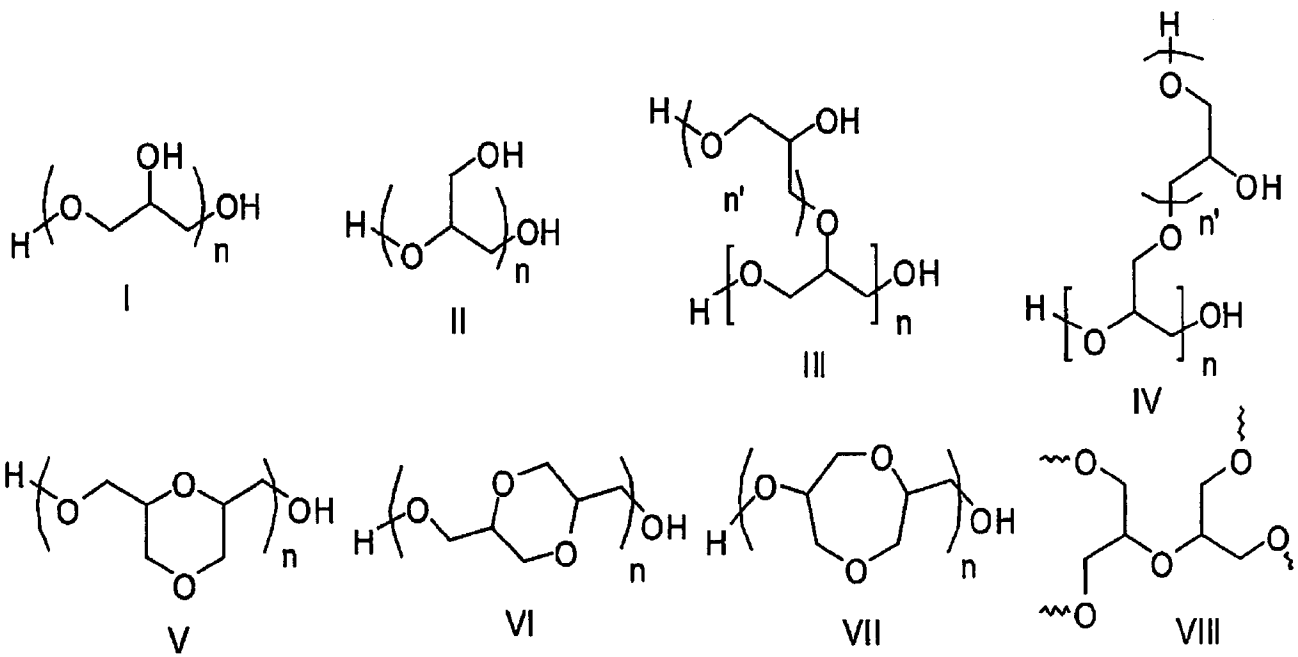
FIG. 2 is an illustration of the structures of suitable repeating units, which may be used in the polyglycerols used in the inventive film.

In at least one embodiment, the polyglycerol may have a structure as illustrated in FIG. 1. The polyglycerol comprises a structure including at least two repeating units selecting from at least one of the structures listed in FIG. 2 including but not limited to linear structures I and II, branched, hyperbranched or dendritic structures III, IV, and VIII, cyclic structures V, VI and VII and any combination thereof. Any structure in FIG. 2 can be combined with any structure or structures including itself through any free hydroxyl group functionality in the structure. The cyclic linkages of any basic cyclic structures in FIG. 2 may contain any structure or structures as a part or parts of linkages. In FIG. 1 and FIG. 2 the numbers m, n, n', o, p, q and r in each structure can independently be any numeric number 0, 1, 2, . . . 25. In FIG. 1 R and R' are $(CH_2)_n$ and n can independently be 1 or 0.

In at least one embodiment the modifying agent for Yankee coatings comprises polyglycerol derivatives. The derivatives can be obtained by derivatization of polyglycerols with 1 to 22 carbon atoms. The modification includes but not is limited to alkylation, alkoxylation, esterification and the like.

In at least one embodiment the adhesive compositions of the present invention are applied to the surface of a creping cylinder as a dilute aqueous solution. In an embodiment, the aqueous solution includes from about 0.01 to about 10.0 weight percent of the polymers of the invention. In another embodiment, the polymers of the invention are included in the aqueous solution in a concentration of from about 0.05 to about 5.0 weight percent. In another embodiment, the polymers of the invention are included in the aqueous solution in a concentration of from about 0.1 to about 1.0 weight percent. Those skilled in the art of creping adhesives will appreciate that the reason for such a larger percentage of water in the admixture is in part based on the need to only deposit a very thin layer of adhesive on the creping cylinder, which, in one embodiment, is most easily accomplished with a spray boom.

In at least one embodiment the spraying applications described above may be further improved by a variety of means, for example by using spraybooms designed for double or triple coverage, by oscillating the sprayboom and by recirculation of the diluted release aid composition from the outlet of the sprayboom to improve mixing and reduce the possibility of separation.

In at least one embodiment a release aid that is also in aqueous form is applied to the Yankee dryer along with the polymer adhesive. The release aid provides lubrication between the Yankee dryer surface and the doctor blade used to crepe the tissue paper from the Yankee dryer. The release aid also allows the tissue paper to release from the adhesive during the creping process. Representative release aids include release oils composed of naphthenic, paraffinic, vegetable, mineral or synthetic oil and emulsifying surfactants. In order to form stable aqueous dispersions the release aid is typically formulated with one or more surfactants such as fatty acids, alkoxylated alcohols, alkoxylated fatty acids, and the like. The release aid may be applied to the creping cylinder before or after the adhesive composition, or may be added together with the adhesive for application to the creping cylinder.

In at least one embodiment the adhesive compositions of this invention may also be used in combination with functional additives used in the art to improve the softness of the tissue or towel. Representative functional additives include organic quaternary salts having fatty chains of about 12 to about 22 carbon atoms including dialkyl imidazolinium quaternary salts, dialkyl diamidoamine quaternary salts, monoalkyl trimethylammonium quaternary salts, dialkyl dimethylammonium quaternary salts, trialkyl monomethylammonium quaternary salts, ethoxylated quaternary salts, dialkyl and trialkyl ester quaternary salts, and the like. Additional suitable functional additives include polysiloxanes, quaternary silicones, organoreactive polysiloxanes, aminofunctional polydimethylsiloxanes, and the like.

In at least one embodiment the creping adhesives for preparing creped paper include, but are not limited to, the following: polyamines, polyamides, polyamidoamines, amidoamine-epichlorohydrin polymers, polyethyleneimines, polyvinyl alcohol, vinyl alcohol copolymers, polyvinyl acetate, vinyl acetate copolymers, polyethers, polyacrylic acid, acrylic acid copolymers, cellulose derivatives, starches, starch derivatives, animal glue, crosslinked vinylamine/vinylalcohol polymers as described in U.S. Pat. No. 5,374,334, glyoxalated acrylamide/diallyldimethyl acrylamide copolymers; the polymers described and claimed in U.S. Pat. No. 5,179,150; the polymers described and claimed in U.S. Pat. No. 5,187,219; an admixture of from about 0.1 to about 50 weight percent of a first polyamide-epihalohydrin resin and from about 99.9 to about 50 weight percent of a second polyamide-epihalohydrin resin, as described and claimed in U.S. Pat. No. 6,277,242 B1 and halogen-free creping cylinder adhesives based on cross-linked cationic polyaminoamide polymers as described and claimed in U.S. Pat. No. 5,382,323.

EXAMPLES

The foregoing may be better understood by reference to the following examples, which are presented for purposes of illustration and are not intended to limit the scope of the invention.

Various polyglycerol samples were characterized to determine their bulk viscosity and molecular weight including, commercially available Diglycerol and Polyglycerol-3 from Solvay Chemical International (Belgium) and synthesized materials PG-1, and PG-2 available from Nalco Company (Naperville, Ill.). A description of these samples is provided in Table 1 and shows all of the samples had a higher viscosity and molecular weight than glycerol (MW=92 g/mole). The bulk viscosity of samples was measured by a Rheometer AR2000 (TA Instruments, New Castle, Del.). The measurements were performed in a rotational mode at a shear rate of 5 $s^{-1}$ and 40° C. A 60 mm parallel plate was used with a gap of 2000 μm. For molecular weight measurements, all samples were analyzed with a SEC method (size exclusion chromatography) and the reported molecular weights (MW) were weight average molecular weights based on calibration of PEG/PEO standards. Base condensation prepared polyglycerols can contain lactic acid or lactate.

TABLE 1

Descriptions and molecular weight characterizations of polyglycerol samples

| Sample | Type of Polyglycerol | Viscosity (Pa · s) | Mw* |
|---|---|---|---|
| Glycerol | — | 0.26 | 92 |
| Diglycerol | Epi-crosslinked | 2.3 | 140 |
| Polyglycerol-3 | Epi-crosslinked | 6.6 | 200 |
| PG-1 | Base Condensation | 35 | 320 |
| PG-2 | Base Condensation | 130 | 540 |

*Excludes glycerol monomer

Example 1

General procedure for the production of polyglycerols: A reaction mixture of glycerol (500.0 parts) and NaOH or KOH solution (3 to 10% by weight of active relative to the total weight of reaction solids) was stirred and gradually heated up to 230 to 260 degrees Celsius under particular inert gas flow rates. The reaction mixture was stirred at this temperature for a desired reaction time (in hours), and in-process samples were drawn after two hours and every one or two hours thereafter for product characterizations. Nitrogen flow rates at 0.2 to 8 mol of nitrogen per hour for each mol of glycerol or vacuum pressures less than 760 mm Hg were applied starting from reaction time between 0 to 4 hours to the end of the reaction. The polyglycerol products were used for the application directly or after dilution with water, with or without pH adjustment.

Example 2

Figure 3:
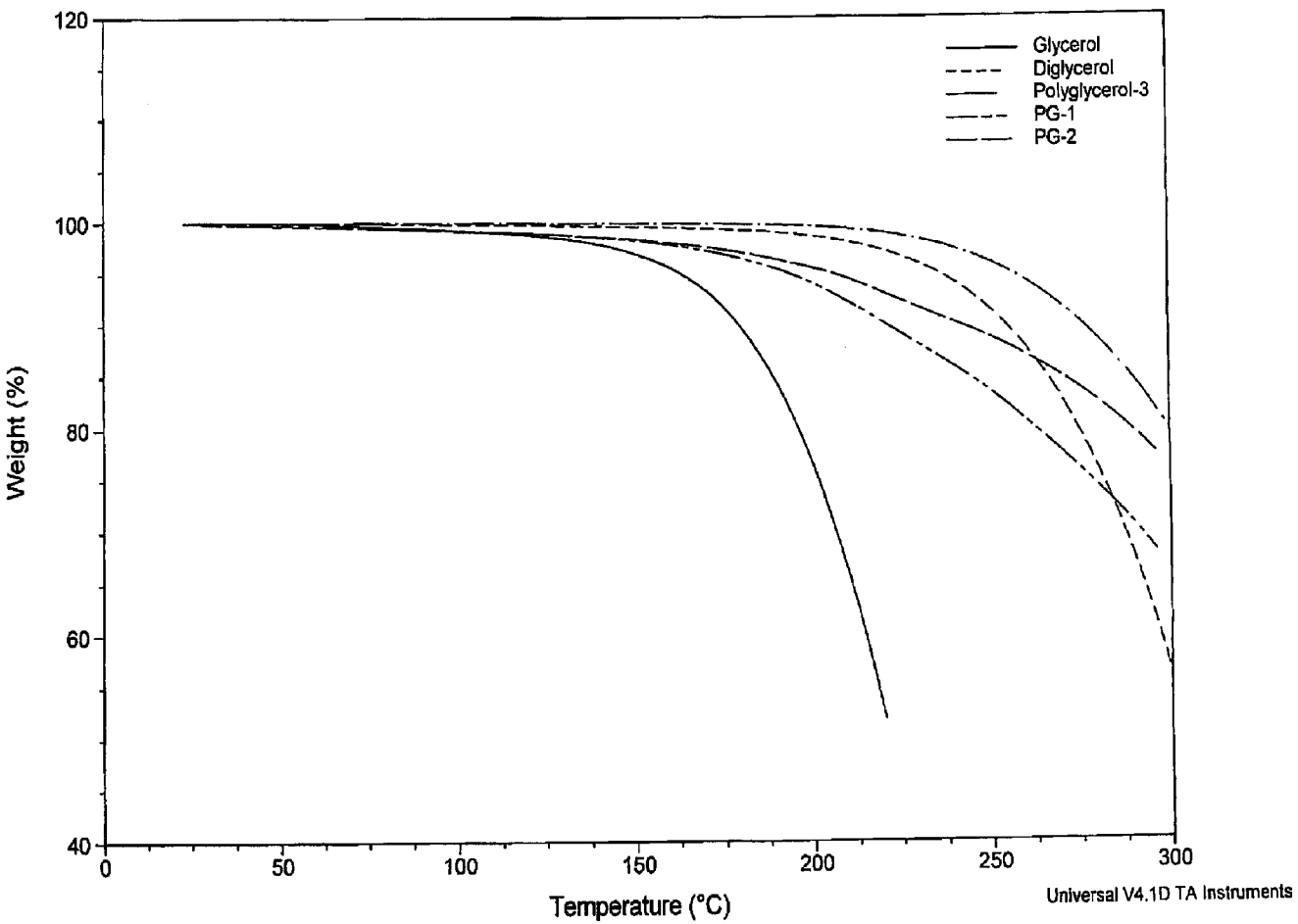
FIG. 3 is a graph showing the improved volatility properties of the inventive modifiers.

The volatility of polyglycerol samples was determined by thermogravimetry (TGA). FIG. 3 is the overlay of TGA weight-loss curves for glycerol and various polyglycerol samples. Table 2 lists the temperature at which 5% weight-loss occurs in the samples. The 5% weight-loss of glycerol occurs at 162° C., whereas the 5% weight-loss of polyglycerol samples occurs at significantly higher temperatures. This indicates that all of the polyglycerol samples are less volatile than glycerol. About 20-40 mg of samples were analyzed by TGA (TA Instruments, New castle, DE) at a heating rate of 10° C./min in an air atmosphere (flow rate: 90 ml/min).

TABLE 2

5% weight-loss temperature determined by TGA

| Sample | Temperature (° C.) |
|---|---|
| Glycerol | 162 |
| Diglycerol | 235 |
| Polyglycerol-3 | 255 |
| PG-1 | 192 |
| PG-2 | 204 |

Example 3

Figure 4:
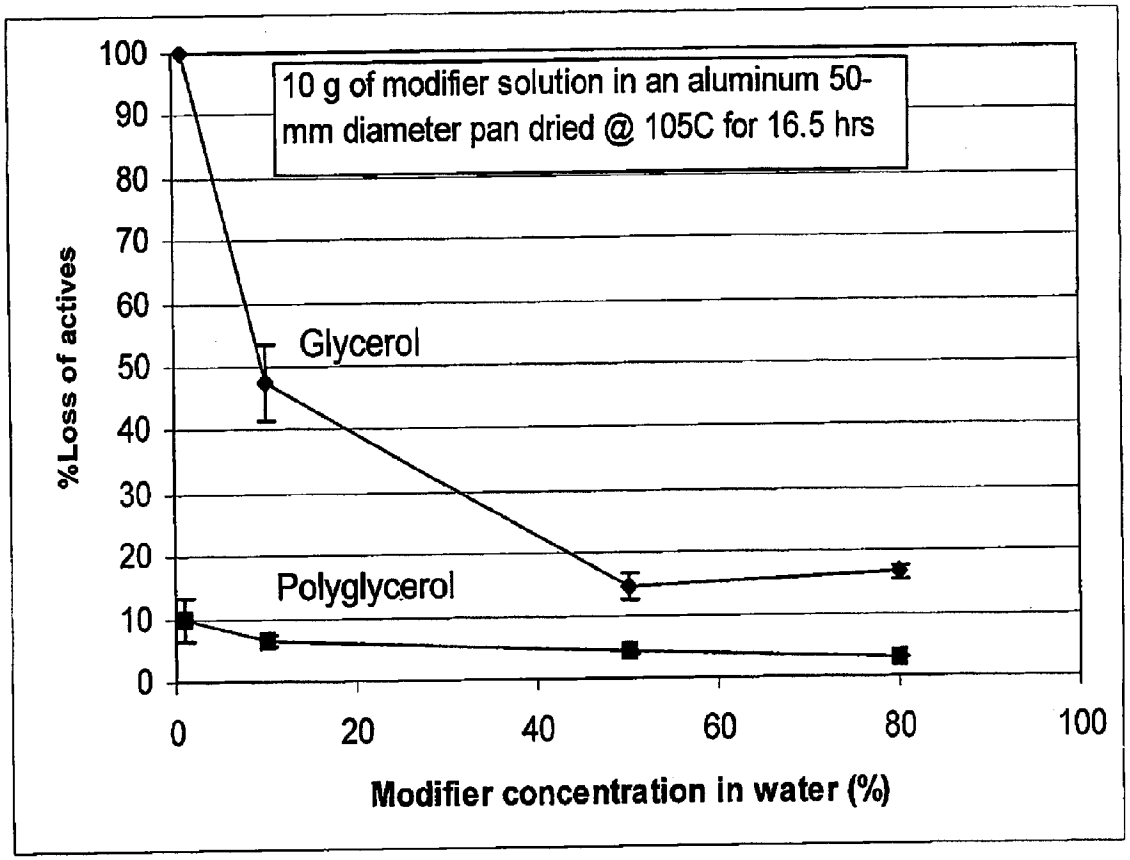
FIG. 4 is a graph showing the improved resistance to weight loss of the diluted modifiers.

The lower volatility of polyglycerol compared to glycerol in dilute aqueous solutions is illustrated in FIG. 4. As the modifier concentration becomes more dilute, the advantage of polyglycerol over glycerol becomes more apparent. At 1% modifier concentration, practically 100% of the glycerol modifier is lost after drying at 105° C. for 16.5 hours. In contrast only 10% of the polyglycerol modifier is lost.

Example 4

The plasticizing properties of polyglycerol, when formulated as part of a Yankee dryer composition, was demonstrated from glass transition temperature (Tg) and shear storage modulus (G') measurements. The polymer Tg was measured by Differential Scanning Calorimetry, and the G' of the polymer film was measured by rheometer. Table 3 shows the effect of modifiers on the Tg and G' of PAE-based film. The results demonstrate that polyglycerol is as an effective plasticizer as glycerol. Polyglycerol reduced the Tg in a similar fashion as glycerol, and the polyglycerol-modified PAE film is a softer film compared to the unmodified film. A TA Q200 Differential Scanning Calorimeter (TA Instruments, New Castle, Del.) was used for Tg measurement. Polymer samples were prepared by casting films in a polypropylene dish. The samples were dried at 105° C. in an oven overnight. About 10-15 mg of sample was sealed in a DSC pan with lid. The sample was heated at a rate of 10° C./min Tg was determined from the second scan using a half height method. The shear storage modulus G' was measured by a rheometor AR2000 (TA Instruments, New Castle, Del.). Polymer films were prepared by casting from a 5% (w/w) solution. The film was dried in an oven at 95° C. overnight. The dry film was punched with a die (8 mm in diameter). The 8 mm disc was further dried in a vacuum oven at 110° C. for two hours. The shear storage modulus G' was measured using 8 mm parallel plate at 110° C. and 1 Hz.

TABLE 3

Effects of modifiers on the glass transition temperature and shear storage modulus of PAE resin

| Sampale | Tg (° C.) | G' (kPa) |
|---|---|---|
| PAE | 76 | 1500 |
| PAE + Glycerol | 55 | 510 |
| PAE + PG-2 | 57 | 770 |

Example 5

Figure 5:
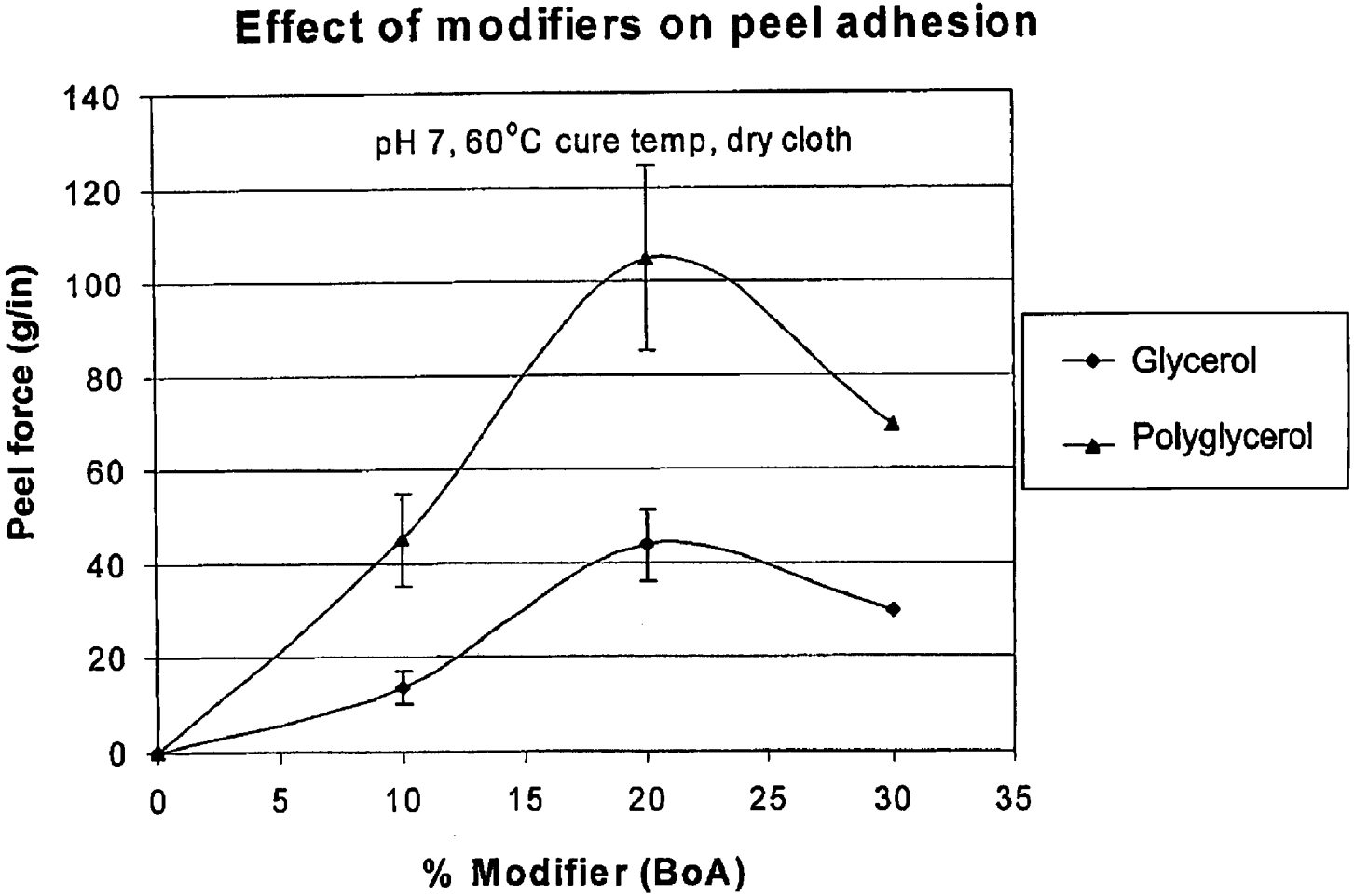
FIG. 5 is a graph showing the improved dry tack strength of the inventive film.

In order to compare the effect of polyglycerols and glycerol on adhesion, a dry tack peel test was performed. This test measured the force required to peel a cotton strip adhered to a heated metal plate. First a PAE adhesive composition was applied to the metal plate by a #40 coating rod. The adhesive applied to the plate had no more than 15% solids. The plate was heated to 100° C. and a dry cotton strip was pressed against the plate by a 1.9 kg cylindrical roller. The metal plate was then heated to 105° C. and the strip was left to dry for 15 minutes. The metal plate was then clamped to a testing apparatus and the cloth was peeled off the plate at an angle of 180° at a constant speed. The results of the test shown in FIG. 5 demonstrate the effectiveness of the invention. The sample with no modifier showed no dry tack adhesion because as the PAE adhesive film dried out, the film became brittle and too hard for the cotton strip to adhere to. While the glycerol modifier can make the film softer which increased the dry tack adhesion, FIG. 5 makes clear that the polyglycerol containing films, had superior dry tack adhesion when compared to films containing glycerol as a modifier.

This data also makes clear that because polyglycerol functions as such an effective placticizer, even if in a rare circumstance, a residual amount of glycerol would be present in a sample of polyglycerol modified film, the residual glycerol would not function effectively as a plasticizer for the polyamidoamine/epihalohydrin since the greater abundance and effectiveness of the polyglycerol would overwhelm any effect from residual glycerol. Moreover FIG. 3 makes clear that because polyglycerols are less volatile under certain conditions of use, (for example 100 to 162 degree environments) in those conditions, glycerol is not an effective plasticizer for the polyamidoamine/epihalohydrin resin because it vaporizes away while the retained polyglycerols do function as placticizers.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and incorporated herein.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), end ending with a maximum value of 10 or less, (e.g. 2.3 to 9.4, 3 to 8, 4 to 7), and finally to each number 1, 2, 3, 4, 5, 6, 7, 8, 9, and 10 contained within the range.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of creping a paper web comprising the steps of:

a) applying to a rotating creping cylinder a coating composition, the coating composition comprising at least one adhesive agent, at least one release agent, and at least one polyglycerol;

b) pressing the paper web against the creping cylinder to effect adhesion of the paper web to the creping cylinder; and c) dislodging the paper web from the creping cylinder with a doctor blade wherein the coating composition has superior dry tack adhesion properties and lower volatility than a similarly constituted coating composition which contains glycerol instead of polyglycerol would.

2. The method of claim 1 wherein the coating composition remains plasticized at a temperature beyond the volatility limit of glycerol.

3. The method of claim 1 wherein the polyglycerol is between 1 and 70% of the coating composition.

4. The method of claim 1 wherein the coating composition has a glass transition temperature of less than 100° C.

5. The method of claim 1 wherein the coating composition is readily rewettable after the paper has been dislodged from the creping cylinder.

6. The method of claim 1 wherein the polyglycerols is selected from the group consisting of: polyglycerol according to the formula

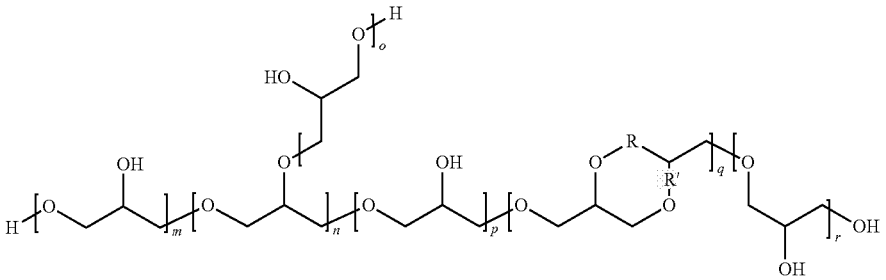

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

wherein m, n, o, p, q, and r are equal to an integer between more than 0 and less than 25, polyglycerol formed by crosslinking glycerol with epichlorohydrin, base condensation polyglycerols, polymerization of glycidol-based monomers, and any combination thereof.

7. The method of claim 1 where the polyglycerol structure is selected from the group consisting of: linear, branched, hyperbranched, dendritic, cyclic and any combination thereof.

8. The method of claim 1 wherein the polyglycerol has a molecular weight greater than 100 g/mole.

9. The method of claim 1 wherein the coating further comprises one item selected from the group consisting of polyaminoamide-epichlorohydrin (PAE) resins, polyamine-epichlorohydrin resins, polyacrylamides, polyvinylamines, polyvinylpyrrolidones, natural polymers, derivitized natural polymers, starch, guar gum, carboxymethyl cellulose, hydroxyethyl cellulose, hydroxypropyl cellulose, functional additives, organic quaternary salts having fatty chains of about 12 to about 22 carbon atoms, dialkyl imidazolinium quaternary salts, dialkyl diamidoamine quaternary salts, monoalkyl trimethylammonium quaternary salts, dialkyl dimethylammonium quaternary salts, trialkyl monomethylammonium quaternary salts, ethoxylated quaternary salts, dialkyl and trialkyl ester quaternary salts, polysiloxanes, quaternary silicones, organoreactive polysiloxanes, amino-functional polydimethylsiloxanes, polyamines, polyamides, polyamidoamines, amidoamine-epichlorohydrin polymers, polyethyleneimines, polyvinyl alcohol, vinyl alcohol copolymers, polyvinyl acetate, vinyl acetate copolymers, polyethers, polyacrylic acid, acrylic acid copolymers, cellulose derivatives, starches, starch derivatives, animal glue, crosslinked vinylamine/vinylalcohol polymers, glyoxalated acrylamide/diallyldimethyl acrylamide copolymers, halogen-free creping cylinder adhesives based on cross-linked cationic polyaminoamide polymers, and any combination thereof.

10. The method of claim 1 wherein the coating composition further comprises lactic acid or lactate salt.

11. The method of claim 1 wherein the coating further comprises one item selected from the group consisting of release agents, phosphate based modifiers, and functional additives.

12. The method of claim 1 wherein the coating composition comprises one item selected from the group consisting of polyglycerols, polyglycerol derivatives, glycerol-based polyols, and any combination thereof.

13. The method of claim 1 wherein the release aid comprises one selected from the group consisting of: release oils composed of naphthenic, paraffinic, vegetable, mineral or synthetic oil and emulsifying surfactants, release aids formulated with one or more surfactants such as fatty acids, alkoxylated alcohols, alkoxylated fatty acids, and any combination thereof.

14. The method of claim 1 wherein the coating composition is applied as an aqueous solution, an emulsion, or a dispersion.

* * * * *